United States Patent [19]

Argyrakis

[11] Patent Number: 4,711,178

[45] Date of Patent: Dec. 8, 1987

[54] AMMUNITION INCORPORATING SEARCHING FUSE WITH TRAJECTORY CORRECTABLE DURING ITS FINAL FLIGHT PHASE AND METHOD FOR COMBATING ARMORED TARGET OBJECTS

[75] Inventor: Nikolaus Argyrakis, Nuremberg, Fed. Rep. of Germany

[73] Assignee: Diehl GmbH & Co., Nuremberg, Fed. Rep. of Germany

[21] Appl. No.: 855,078

[22] Filed: Apr. 22, 1986

[30] Foreign Application Priority Data

May 9, 1985 [DE] Fed. Rep. of Germany ..... 3516673

[51] Int. Cl.[4] ..... F42B 25/24

[52] U.S. Cl. ..... 102/384; 102/387

[58] Field of Search ..... 102/384, 387; 244/3.22

[56] References Cited

U.S. PATENT DOCUMENTS

| | | | |
|---|---|---|---|
| 4,050,381 | 9/1977 | Heinemann | 102/387 |
| 4,417,520 | 11/1983 | Maudal | 102/384 |
| 4,492,166 | 1/1985 | Purcell | 102/384 |
| 4,568,040 | 2/1986 | Metz | 102/384 |
| 4,622,900 | 11/1986 | Witt et al. | 102/387 |

FOREIGN PATENT DOCUMENTS

| | | | |
|---|---|---|---|
| 81421 | 6/1983 | European Pat. Off. . | |
| 3306659 | 8/1984 | Fed. Rep. of Germany | 102/384 |
| 2167536 | 5/1986 | United Kingdom . | |

*Primary Examiner*—Charles T. Jordan

*Attorney, Agent, or Firm*—Scully, Scott, Murphy & Presser

[57] ABSTRACT

Ammunition incorporating a sensing fuse and a parachute, and which has the trajectory thereof correctable during its final flight phase, and a method for the combating of armored target objects with the utilization of such ammunition. The ammunition with the sensing fuse is equipped with a pulse transmitter for a course alignment or correction in the direction towards the lateral or sideways offset of a target object which has been detected by the sensing fuse, and with devices for suspending the action of a parachute during the approach to a target by the ammunition along a quasi-ballistic trajectory.

5 Claims, 1 Drawing Figure

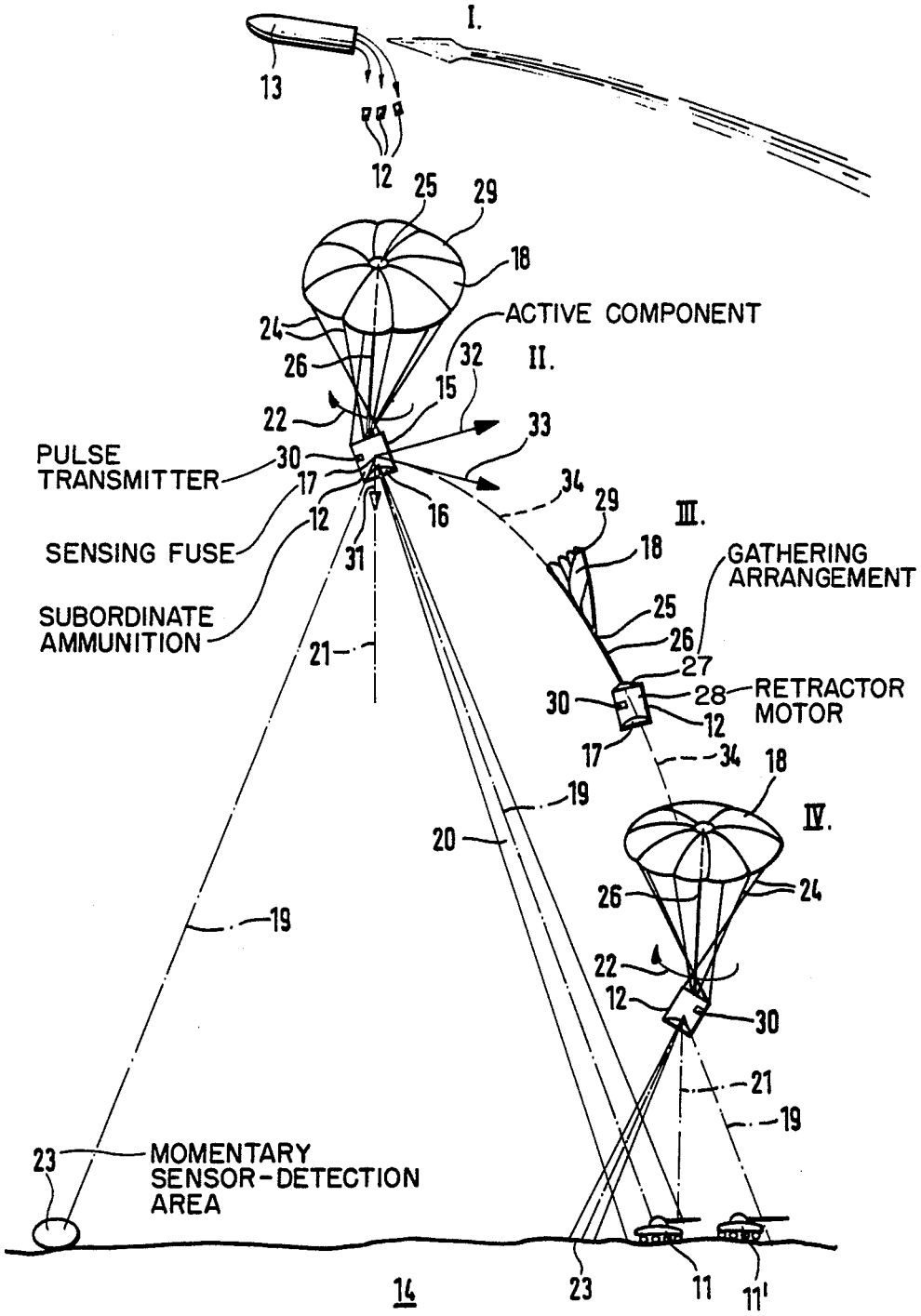
I.
13
12
25
29
18
ACTIVE COMPONENT
24
26
32
II.
15
22
33
PULSE TRANSMITTER
30
17
34
29
12
16
III.
SENSING FUSE
31
18
GATHERING ARRANGEMENT
SUBORDINATE AMMUNITION
25
21
26
27
30
28
RETRACTOR MOTOR
12
17
34
18
19
IV.
20
26
24
19
22
12
30
21
19
23
MOMENTARY SENSOR-DETECTION AREA
14
23
11
11'

AMMUNITION INCORPORATING SEARCHING FUSE WITH TRAJECTORY CORRECTABLE DURING ITS FINAL FLIGHT PHASE AND METHOD FOR COMBATING ARMORED TARGET OBJECTS

BACKGROUND OF THE INVENTION

1. Field of the Invention

The present invention relates to ammunition incorporating a sensing fuse and a parachute, and which has the trajectory thereof correctable during its final flight phase. The invention also relates to a method for the combating of armored target objects with the utilization of such ammunition.

2. Discussion of the Prior Art

The ammunition can pertain to directly fired flying bodies, such as missiles or projectiles, which enter into a parachute-retarded phase of movement upon approach to a target, in order to undertake a correction in direction towards the target under the guidance of a position-finding installation, prior to the detonation of the warhead in order to attain the most effective attack against the target. Preferably, the invention is utilized in a subordinate ammunition article incorporating a sensing fuse, which is of the type generally described in the disclosure of U.S. Pat. No. 4,050,381, and known as SADARM in the military technology.

Measures of the general class under consideration, which are employed for the attacking of ground targets from the air, are known from the disclosure of German Laid-Open patent application No. 33 23 685. In that instance, the subordinate ammunition is equipped with a directionally-guidable glide parachute in order to, with an initially greatest possible search radius; in essence, from a higher position-finding elevation, achieve an approach to the target until there is reached the effective distance of the warhead.

SUMMARY OF THE INVENTION

The present invention is based on the recognition that the demands on apparatus and equipment for the directionally and distance-governed approach to the target with the utilization of a directionally-guidable glide parachute is, nevertheless, excessively considerable, and in particular allows for only a relatively slow approach to the target, which can be adversely influenced to a great extent by ground winds or air currents. As a result, the subordinate ammunition is considerably endangered by defensive fire directed against the ammunition. Moreover, a target object which is capable of maneuvering has good chances of being able to evade the dangers of attack through sudden or rapid maneuvers in course, which can hardly be followed by the relatively wide trajectory of a directionally-guidable glide parachute.

It is in recognition of these conditions that the present invention has as its object to so equip an article of ammunition of that type incorporating a sensing fuse, whereby on the basis of a more rapid approach to the target object, the defense and evasive capabilities of the latter are substantially more restricted, and consequently, there can be noticeably increased the degree of effectiveness in the utilization of the ammunition.

The foregoing object is inventively achieved in that the ammunition with the sensing fuse of the type under consideration is equipped with a pulse transmitter for a course alignment or correction in the direction towards the lateral or sideways offset of a target object which has been detected by the sensing fuse, and with devices for suspending the action of a parachute during the approach to a target by the ammunition along a quasi-ballistic trajectory.

Furthermore, another object of the invention resides in providing a method for utilizing the inventive ammunition whereby, upon an initial acquisition of a target object from a high elevation, the ammunition is imparted an impulse-like displacement during a reduced effect by the parachute, so as to enter a quasi-ballistic trajectory towards the target object, whereupon, after falling below a maximum effective distance for the warhead, there is again implemented the transition into the target acquisition from the parachute-retarded descending falling movement of the ammunition.

Pursuant to the inventive concept, a pulse-like correction of the momentary direction of movement of the ammunition which descends into the target area while suspended from the parachute, is implemented in a direction towards the detected target object with a transition into a quasi-ballistic trajectory, after the braking or retarding effect of the parachute is temporarily practically suspended. For this timely optimized approach to the target object, the parachute (which inhibits a rapid displacing and descending movement) can be loped off, and after a sufficient approach to the target, a new parachute can be unfolded, such that, after falling below the maximum effective distance to the target object, there are again afforded quasi-stationary descending conditions for the functioning of the sensing fuse.

However, it is more expedient that also for the attack phase is there again employed that parachute which already served during the introductory search phase for the retarded descent of the ammunition. In this instance, during the accelerated approach phase (along the ballistic trajectory) the braking or retardant action of the parachute is reduced to a stabilizing action. From an equipment standpoint, this can be most simply implemented through an inverting of the parachute, in which the middle region of the parachute is pulled forwardly in the direction of movement. Through a release of the middle region, the parachute will then again unfold; in essence, the trajectory again moves into a retarded descending phase with a defined spatial motion of the ammunition and its sensing fuse.

BRIEF DESCRIPTION OF THE DRAWING

Additional alternatives and modifications, as well as further features and advantages of the invention, may now be readily ascertained from the following detailed description of an exemplary embodiment of the invention, taken in conjunction with the single figure of drawing which is illustrative of the utilization of the inventively equipped article of ammunition, and which represents a sequence of the different operational phases during an attack against movable ground target objects by means of the sensor-guided subordinate ammunition.

DETAILED DESCRIPTION

The I. operational phase of the attack against movable armored target objects 11, which is indicated in the drawing, consist of in transporting subordinate ammunition 12 by means of a carrier 13; for instance, a projectile, a rocket, or any suitable flying body or missile, over the detected or presumed target area 14, and to eject the ammunition at that location. The subordinate ammunition 12 possesses an active component 15 with a warhead 16, and a sensing fuse 17, as well as at least one parachute 18.

The warhead 16 is preferably equipped with an insert which, by means of an explosive, is deformable into a projectile which can be fired against the target object 11. The sensing fuse 17 serves for the acquisition of a target object 11 which is actually to be attacked within the target area 14, and for the delivery of a triggering or detonating information, when such a target object 11 is located, at a suitable distance, in the effective direction of the warhead 16; further technological measuring tasks, such as especially a measurement of the height above the target area 14, and the guidance information obtained therefrom, can be assumed by the sensors of the sensing fuse 17, or undertaken in separately provided measuring devices. The parachute 18 serves for the braked or retarded descent of the subordinate ammunition 12, which is delivered from its carrier 13, into the target area 14, in order to have adequate time available for the scanning of a large target area 14 from an initially great height for a target object 11 which is to be attacked.

The scanning of the target area 14 which is carried out during the II. operational phase can be basically carried out through a suitable electronic or mechanical displacement or pivoting of the antenna-detection characteristic 20 of the passively or actively operating sensing fuse 17. From an apparatus standpoint, it is the simplest that the detection characteristic 20 be arranged rigidly, under consideration of a peripheral load, which is timely required for the signal processing, in the direction of the rotational movement 22 ahead of the effective direction 19, at the same angle of inclination as the effective direction 19 for the warhead, which results from the eccentric suspension of a subordinate ammunition 12 below its parachute 18 at an acute angle relative to the vertical axis 21. When, through applicable flow guiding surfaces along the outer casing surface of the subordinate ammunition 12 and/or through applicability configured openings on the parachute 18, the subordinate ammunition 12 carries out a rotational movement 22 about the vertical axis 21 relative to the target area 14, resulting therefrom is an arcuate course of the momentary sensor-detection area 23 for the antenna- characteristics 20 in the target area 14. The radius of this course of movement reduces with the descent of the subordinate ammunition 12 into the target area 14, from which there is obtained a somewhat spirally-shaped scanning of the target area 14 for the acquisition of a target object 11.

However, at the initial detection of a target object 11, as a rule the distance to the subordinate ammunition 12 is still too great for the intended technical effect of the ammunition in the target. Consequently, there is provided an approach to the target as a III. operational phase.

For the implementation of the foregoing, pursuant to the preferred embodiment, there is arranged a gathering line 26 between the actual subordinate ammunition 12 and its parachute 18, in addition to the usual shroud lines 24, which line 26 is fastened in the middle region 25 of the parachute 18, which is connected in the subammunition 12 to a gathering arrangement 27 which includes a retractor motor 28. This motor is designed that, for example, by means of grip rollers or a cable drum (not shown), the gathering line 26 is retracted and, as a result, will cause the middle region 25 of the parachute 18 to be displaced in the descending direction ahead of the parachute edge region 29, and thereby, due to the practically rearwardly inverted and axially folded-together parachute 18, its retardant or braking supporting behavior will be suspended or eliminated to the greatest extent. The motor 28 can be constituted of an electric motor (powered from electrical energy supply for the subordinate ammunition 12), or a turbine motor (powered with the reaction gases of a gas generator or propulsion unit).

When the gathering arrangement 27 again releases the gathering line 26, the flapping behavior of the rearwardly folded parachute 18 will then again lead to its normal unfolding; with the now again stiffly tensioned shroud lines 24 at an again ineffective (released or even loped off) gathering line 26.

In order to be able to rapidly attain a guided approach to the vicinity in the target area 14 in which there has been detected a target object 11, the subordinate ammunition 12 is equipped with a pulse transmitter or generator 30 which vectorially superimposes a pulse-like offsetting component 32 on the momentary direction of the descending speed 31; such that there is obtained a corrective component of motion 33 in a direction towards the lateral or sideways offset of the target object 11. For this purpose, in the casing area of the subordinate ammunition 12, in the plane of the center of gravity thereof and concurrently in the drawing plane, oriented through the directions 19–21 opposite to the side of the antenna-detection characteristic 20, a pulse transmitter 30 at least one pulsing charge or a pulse-jet propulsion unit (for instance, a plurality thereof adjacent each other, whose simultaneous or controllably sequentially triggered effects will timely-vectorially superimpose for the described effect of the pulse transmitter 30). The actuation of the pulse transmitter 30 thus produces an acceleration of the subordinate ammunition 12 in the offsetting direction 32.

Desirable for a rapid approach to the target during the III. operational phase is a somewhat ballistic trajectory 34 with a descending orientation in the resultant direction of motion 33. For this purpose, the braking or retarding effect of the parachute 18 is minimized in that, immediately prior to the actuation of the pulse transmitter 30 its gathering line 26 (as described above) is retracted. Inasmuch as the direction 32 of the pulse transmitter 30, due to the inclination of the subordinate ammunition 12, possesses a force component directed opposite to the center of gravity (and this component can be further increased by an adjustment of the effective direction 32 of the pulse transmitter 30), upon the actuation of the pulse transmitter 30 there are unloaded the lines 24, 26, so that the energy requirement for the gathering arrangement 27 becomes extremely low at an applicable timely correlation of its operation.

Since a certain time interval is required for the gathering operation, the resultant orientation of the pulse transmitter 30 is expediently peripherally pivoted opposite the direction of rotation 22. Thereby, the desired offsetting direction 32 is then also approximately afforded when (after detection of a target object 11 during the II. operational phase) the transition into the quasi-ballistic III. operational phase is delayed until the parachute 18 is folded together and its gathering line 26 also retracted.

The cloth or canopy material of the parachute 18, which is folded together during the III. operational phase opposite the direction of movement, in a desirable manner has the consequence that the coarse or general orientation of the sensing fuse 17 in a direction towards the target object 14 is maintained stable. As a result thereof (through the release of the gathering line 26 for the repeated unfolding of the parachute 18) it is possible to implement an uncomplicated transition into the IV. operational phase, in which the subordinate ammunition 12 is again subjected to a braked rotating descending flight, after there has been reached or fallen below the maximum effective range, from the standpoint of ammunition technology, to the target object 11 (in effect, by the given trigonometric angle dependency, the maximum height above the target area 14) along the quasi-ballistic trajectory 34.

When the detection characteristic 20 has now acquired a target object 11' due to the smaller distance (which can relate to the already previously detected, which in the interim has moved further, or another target object) then the warhead 16 detonates from an optimized distance, and thereby with the greatest possible effect in the target.

What is claimed is:

1. In an article of ammunition including a sensing fuse, and a parachute, wherein the trajectory of the article is correctable during the final phase of flight thereof, the improvement comprising: said ammunition having a pulse transmitter for producing an offsetting directional component in a direction towards the sideways offset position of a target object which is detected by the sensing fuse; means for suspending the action of the parachute during approach of the ammunition towards a target along a quasi-ballistic trajectory; and a sensor-guidable gathering arrangemnt operatively connected to said parachute for respectively suspending and reinstating the action of said parachute.

2. Ammunition as claimed in claim 1, wherein the gathering arrangement includes a retractor motor for a line which is fastened to the middle region of the canopy of the parachute.

3. Ammunition as claimed in claim 2, wherein the middle region of the parachute is maintained in the direction of movement ahead of the edge region of the parachute which folded together behind said middle region during movement of said ammunition in said quasi-ballistic trajectory.

4. A method for the attacking of armored target objects with ammunition including a sensing fuse, wherein the trajectory of said ammunition is correctable during its final phase of flight; said ammunition descending into a target area suspended from a parachute and approaching the target object while sensor-guided, prior to a warhead in said ammunition being detonated for the deformation and firing of an explosive insert; the improvement comprising: imparting an impulse-like offsetting component to the direction of movement of the ammunition upon the initial detection of a target object at a high elevation during a reduced parachute-supported action such that the ammunition assumes a quasi-ballistic trajectory towards the target object; and upon falling below a maximum effective distance of the warhead to the target object, the ammunition is again imparted a transition into target acquisition from a parachute-retarded descending movement of the ammunition.

5. A method as claimed in claim 4, wherein for effecting the transition into and the movement along the quasi-ballistic trajectory, the middle region of the parachute canopy is pulled in the direction of movement ahead of the edge region thereof and thereby the parachute is folded rearwardly to provide a directionally-stabilized element for the trajectory of the ammunition.

* * * * *